United States Patent [19]

Goldfarb et al.

[11] 4,290,228

[45] Sep. 22, 1981

[54] TOY VEHICLES WITH AUTOMATIC BANKING

[75] Inventors: Adolph E. Goldfarb, 4614 Monarca Dr., Tarzana, Calif. 91356; Delmar K. Everitt, Woodland Hills, Calif.

[73] Assignee: Adolph E. Goldfarb, Tarzana, Calif.

[21] Appl. No.: 121,023

[22] Filed: Feb. 13, 1980

[51] Int. Cl.[3] ..... A63H 17/36; B62D 9/02

[52] U.S. Cl. ..... 46/262; 46/254; 46/251; 46/107; 180/219; 280/772

[58] Field of Search ..... 46/262, 210, 251, 252, 46/253, 254, 249, 256, 211, 213, 206, 107, 101, 106, 97, 98, 99, 100, 201, 202; 180/219, 209; 280/772

[56] References Cited

U.S. PATENT DOCUMENTS

| | | | |
|---|---|---|---|
| 2,248,214 | 7/1941 | Bleeker | 46/107 |
| 2,250,215 | 7/1941 | Berger | 46/211 X |
| 2,649,805 | 8/1953 | Lohr | 46/211 X |
| 3,046,695 | 7/1962 | Henrickson et al. | 46/107 X |
| 3,402,505 | 9/1968 | Nakamura | 46/210 X |
| 3,546,814 | 12/1970 | Melendez | 46/101 X |
| 3,700,059 | 10/1972 | Sutton | 180/209 |
| 3,751,851 | 8/1973 | Nagai | 46/251 X |
| 3,785,086 | 1/1974 | Escobedo | 46/251 X |
| 3,822,880 | 7/1974 | Terzian et al. | 46/251 X |
| 4,124,950 | 11/1978 | Becker | 46/109 |

FOREIGN PATENT DOCUMENTS

| | | | |
|---|---|---|---|
| 152683 | 8/1953 | Australia | 46/211 |
| 938835 | 1/1956 | Fed. Rep. of Germany | 46/213 |
| 1098676 | 8/1955 | France | 46/213 |
| 486320 | 11/1953 | Italy | 46/211 |
| 297881 | 4/1954 | Switzerland | 46/106 |
| 472946 | 10/1937 | United Kingdom | 46/211 |

*Primary Examiner*—G. E. McNeill
*Assistant Examiner*—Mickey Yu
*Attorney, Agent, or Firm*—Romney, Golant, Disner & Ashen

[57] ABSTRACT

Several types of toy vehicles are provided which automatically lean when negotiating turns. One such vehicle is a radio-controlled toy motorcycle, which carries two outriggers with supports that extend downward from the typical positions of a rider's feet. Each outrigger pivots about two independent axes, to bank the toy for negotiating turns. The outriggers are cam-operated from the same radio-controlled steering mechanism which operates the front fork of the toy to turn it. An articulated toy rider has arms which follow the handlebar motions, and legs which follow the outrigger supports—to suggest the illusion that the rider is supporting the motorcycle with his foot on turns. The radio receiver and control electronics, as well as electric motors to drive the rear wheel and the steering mechanism, are powered by dry cells advantageously mounted in the mufflers. Another automatically banking toy vehicle may have the configuration of an airplane, with an undercarriage comprising at least two wheels side-by-side that remain upright and in contact with the supporting surface. A mechanism tilts the entire airframe to left or right, toward the inside of each turn, with respect to the undercarriage. Another automatically banking toy may have the configuration of a four-wheeled car or (with concealed wheels) boat, with a mechanism that lifts the two wheels on one side or the other out of contact with the supporting surface, simulating the behavior of a real boat or car in a very tight, rapid turn.

62 Claims, 17 Drawing Figures

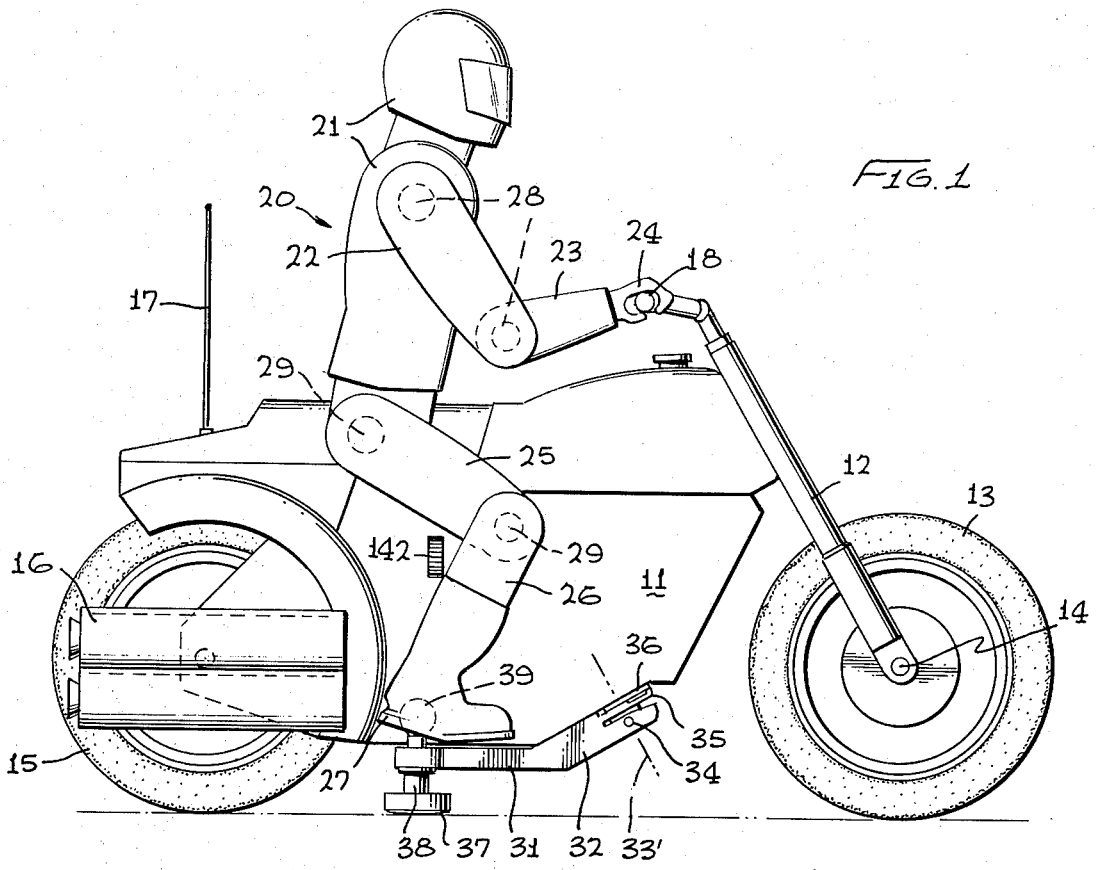
FIG. 1
FIG. 2
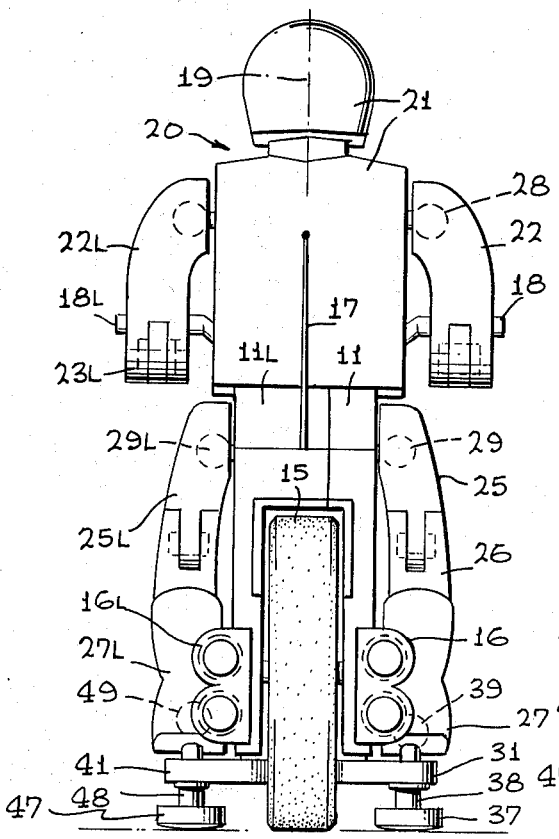
FIG. 3
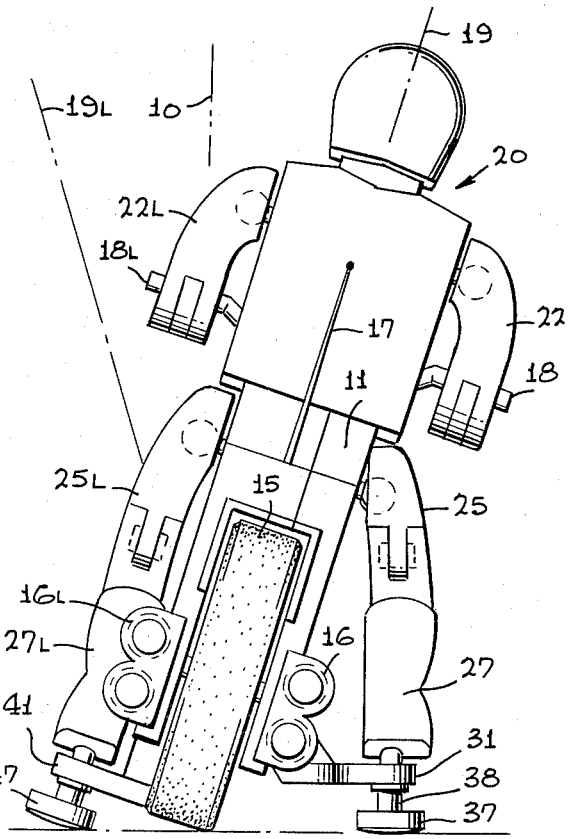

13
14
12
5
6
51
11
7
52
88
78
73
75
36
35
34
141
32
45
44
43
60
31
52
53
97
76H
77
74
33
72
71
92
76
52'
79
84
97
85
82
81
62
63
61
66
65
11T
54
86
83
57
58
55
56
87
59
20
49
48
143
144
39
37
38
145
46
15
47

FIG. 5
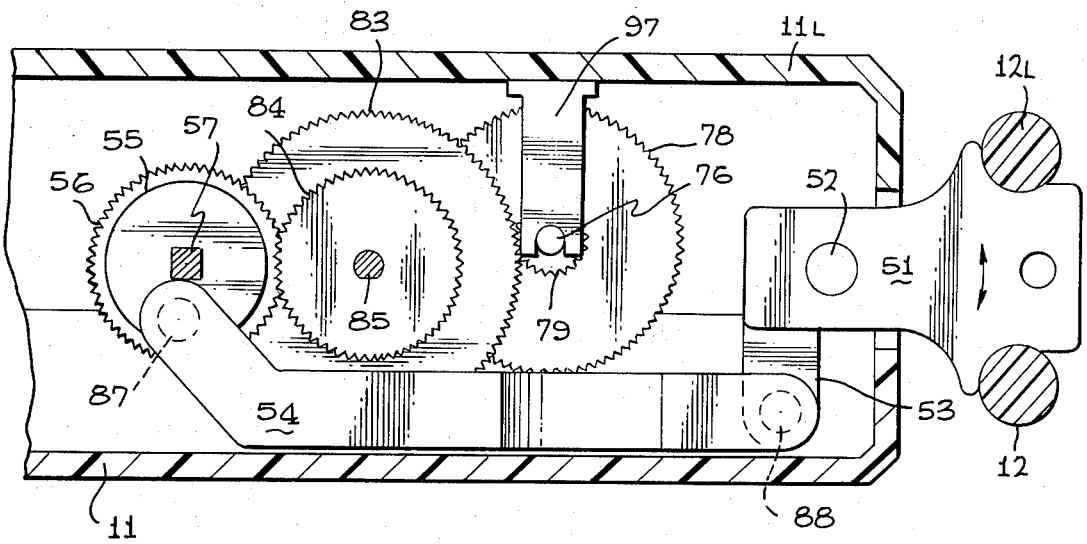
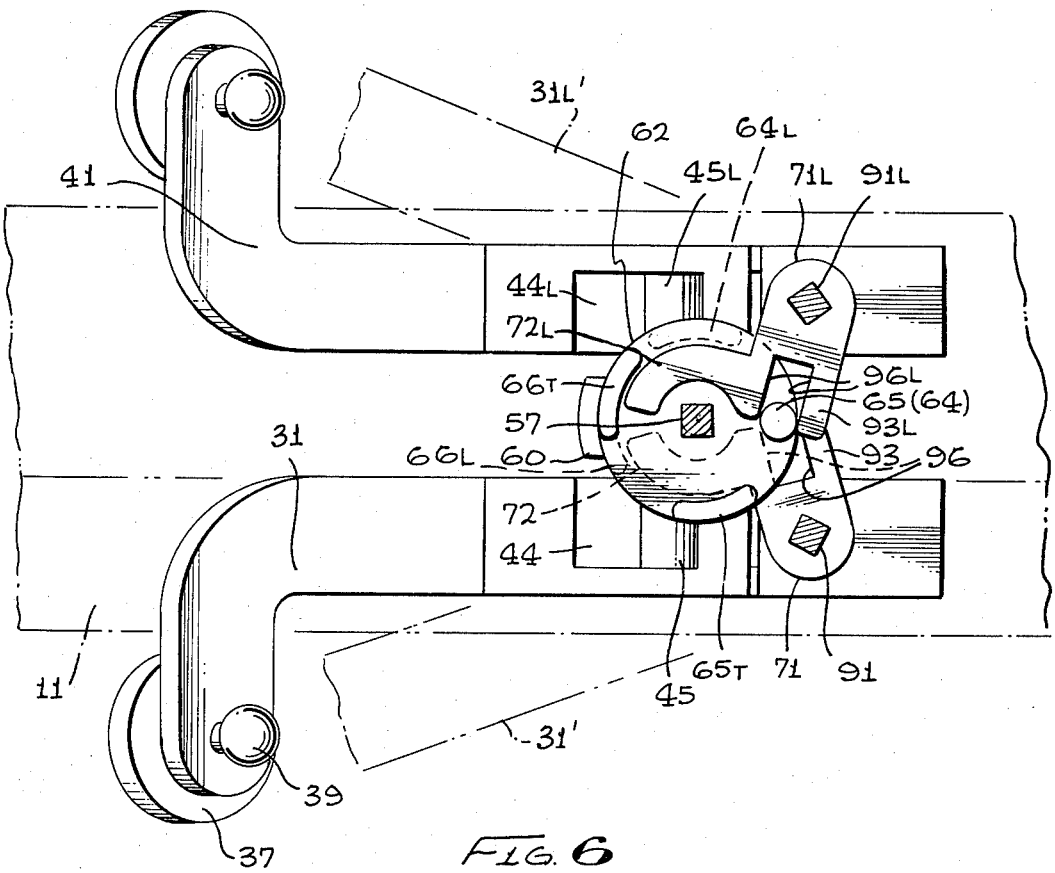
FIG. 6

57
55
84
56
54
52
53
51
60
66L
61J
65T
33
11
64
11L
62
64L
61
63
33L
66T
72L
96L
94L
71L
93L
65
93
33'
94
33L'
71
66T
65T
64
66L
60
41
96
72
95L
11TL
44L
45L
91L
33L
34'
11T
63
92
91
32L
31
44
45
32
33
36
35

FIG. 9
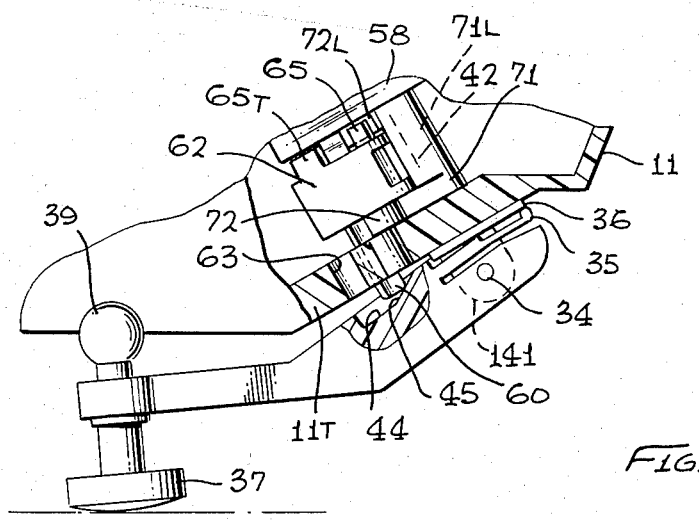
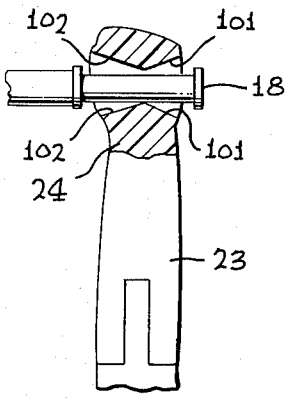
FIG. 10
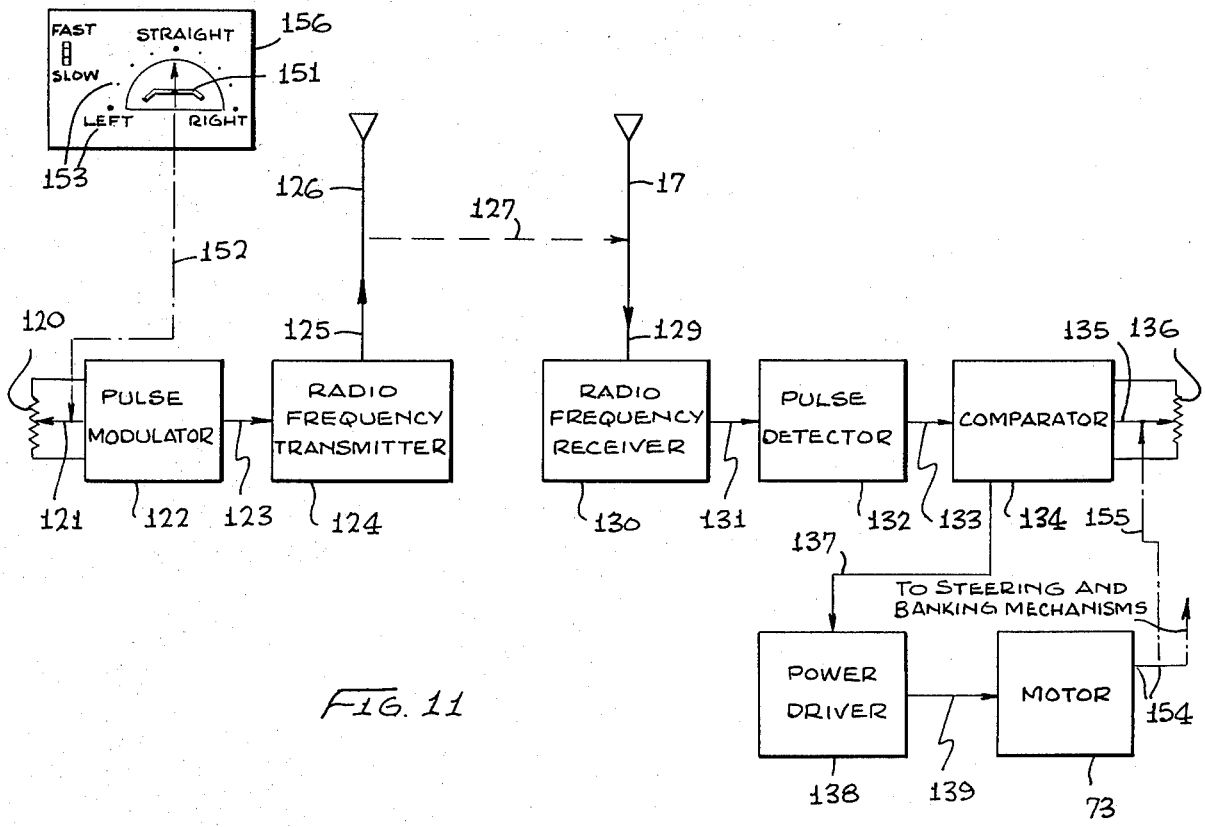
FIG. 11

FIG. 12
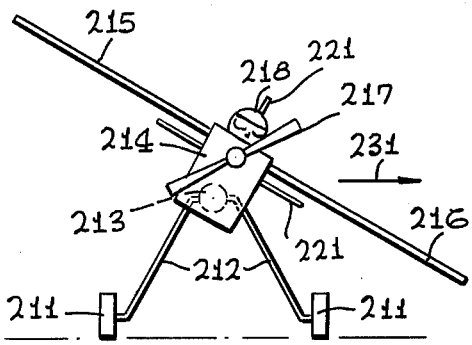
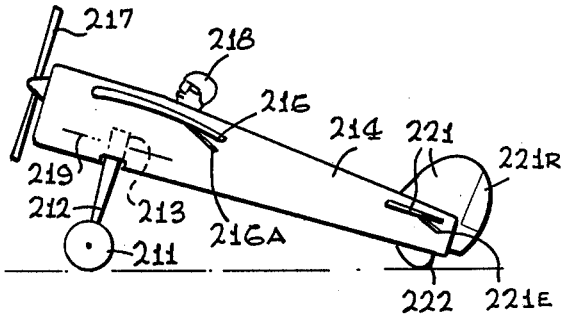
FIG. 13
FIG. 14
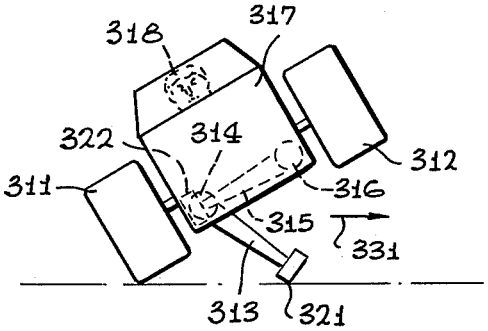
FIG. 15
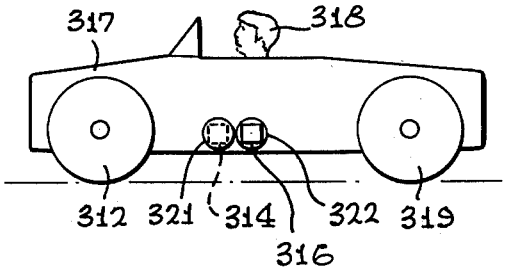
FIG. 16
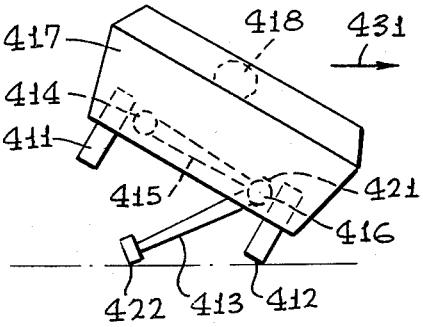
FIG. 17
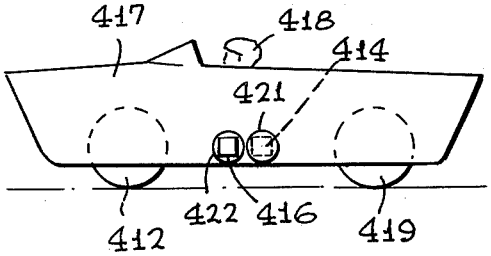

TOY VEHICLES WITH AUTOMATIC BANKING

BACKGROUND OF THE INVENTION

1. Field

This invention is in the field of toy vehicles, and particularly relates to powered, remote-controlled toy vehicles capable of being steered.

The invention is particularly useful in regard to two-wheel vehicles such as toy motor scooters or motorcycles. It is also applicable to three-wheel toy vehicles such as airplanes, and four-wheel toy vehicles such as cars or (with hidden wheels) boats. Certain aspects of our invention are applicable to steerable toy vehicles that are not remotely-controlled, and to such vehicles that are not powered, such as for example gravity-driven toys with mechanically preprogrammed steering.

2. Prior Art

Wheeled toys with banking mechanisms have not to our knowledge been extensively developed, either in the form of self-powered, remote-control toys or as unpowered, and/or non-remote-controlled toys.

Early two-wheel toys were of course unpowered and intended for simple hand play. Wind-up two-wheel toys were pursued very little, due to the problem of balancing such toys in operation. Wind-up toys motorcycles, for example, would naturally take the form of three-wheel motorcycles, or motorcycles with sidecars—eliminating the balance problem, but also departing from the field of two-wheel vehicles.

Some toy motorcycles may have been provided with sideward-extending support bars, perhaps with wheels on the ends similar to the "training wheels" used on real bicycles for young children. Such fixed supports would have the disadvantage of holding the toy vehicle vertical in negotiating turns, rather than simulating the behavior of real two-wheel vehicles, which is to lean or bank toward the inside of the turn. An additional and perhaps even more significant disadvantage would be that if the supports extended far enough to the side to prevent the toy vehicle from tipping over in a sharp turn, they would become very conspicuous, thus further spoiling the illusion of reality generally sought in a toy vehicle.

With the recent upsurge in interest in remote-control and particularly radio-controlled powered toy vehicles, there appeared a new approach to the foregoing problems of the powered two-wheel toy vehicle. This approach is typified by a toy motorcycle available commercially as the Kraft "Eleck Rider". That toy operates essentially like a real motorcycle: turns are to be negotiated primarily by controlling the relationship between forward speed, steering-fork angle, weight shift and traction, so that the vehicle is held in balance between gravity and centrifugal force without exceeding available lateral traction. Needless to say, such a toy is expensive, and extremely difficult to operate, requiring considerable perseverance in practice and the dedication of a devoted radio-control hobbyist to master.

Thus the solution offered by such a device is one which teaches away from that of our present invention. An object of our invention is to provide a relatively inexpensive two-wheel toy which banks around turns without tipping and which nevertheless can be operated remote-control by a child as young as five or six, without any practice at all; and by even younger children with a few minutes of instruction.

We are unaware of any significant prior art in banking toys which have three or more wheels, or two wheels side-by-side. An object of our invention is to provide such toys which lean into or out of turns in such a way as to enhance realism or create an amusing effect, or both.

SUMMARY OF THE DISCLOSURE

The illustrated tandem two-wheel toy vehicle which embodies our invention naturally has many of the features of a real motorcycle: a frame (advantageously in the form of or comprising a casing which houses the working parts of the toy and which is externally configured to resemble a real motorcycle), a rear wheel mounted directly to the frame and a front wheel mounted to the frame by means of a rotatable steering fork, and a source of motive power coupled to the rear wheel to drive the toy vehicle forward.

In addition, the illustrated vehicle advantageously includes apparatus for controlling the angular position of the steering fork relative to the frame, that apparatus in combination with the fork making up a steering mechanism; and a source of motive power coupled to this steering mechanism.

It is also desirable to provide a remote-control system for permitting the user of the toy to change the steering-fork position and the forward velocity without touching the toy motorcycle itself.

Of particular importance, the illustrated toy made in accordance with our invention has a side support mounted to each side of the frame. The side supports engage the surface on which the toy rests, to prevent the toy from falling over sideways and also to effect banking during turns. These side supports are mounted to the frame by means of movable outriggers, which respond to the same steering mechanism provided to adjust the steering fork. The outriggers are operated to lower the side support on the outside of a turn, and to raise the side support on the inside of the turn, relative to the frame, to bank the vehicle toward the inside of a turn.

Optimally the outrigger on the inside of a turn moves outward (as well as upward), to keep the corresponding support well beyond the center of gravity of the toy. Thus the toy is prevented from tipping over toward the inside of the turn as well as toward the outside.

Since the outriggers are controlled from the same mechanism that manipulates the steering fork, the vehicle banks at a greater angle for turns of smaller radius.

For additional realism the toy motorcycle also includes the figure of a rider seated astride the vehicle, with arms and legs respectively attached to the handlebars and outriggers, and so articulated or pliable as to permit the arms and legs to follow the motions of the handlebars and outriggers—giving the appearance of the arms controlling the steering, and the leg on the inside of each turn swinging out to help stabilize the motorcycle.

The illustrated side-by-side two-wheel (or three-wheel) vehicle which embodies our invention is a toy airplane. The toy rests on the two side-by-side wheels plus a third tail-section support which may be with or without a wheel. This toy may be steered by manipulation of the rear support, or by turning the side-by-side wheels, at the designer's option. In either case the steering mechanism actuates a banking mechanism which simply tilts the fuselage and wings toward the inside of each turn—simulating the banking of an airplane in making a turn.

The illustrated four-wheel vehicles which embody our invention are a toy car and a toy boat. They each comprise a pair of roller-ended levers mounted transversely beneath the vehicle: one pivots about a longitudinal axis near the right side of the vehicle, and raises the left side out of contact with the supporting surface; and the other likewise pivots near the left side, to raise the right side. The mechanism in the car is configured to raise the wheels on the inside of each turn, so that the vehicle appears to be careening around each turn on only the outside two wheels. In the case of the boat, however, with its four wheels nearly concealed under and within the hull, the mechanism lifts the two wheels on the outside of each turn, so that the boat leans into each turn.

The foregoing and other aspects of our invention may be more fully understood from the detailed description of preferred embodiments, below, with reference to the accompanying drawings, of which:

BRIEF DESCRIPTION OF THE DRAWINGS

FIG. 1 is an orthographic projection of a preferred embodiment of a toy motorcycle in accordance with our invention, shown in orthographic projection from the right side and shown with the steering mechanism set for straight-ahead travel.

FIG. 2 is a rear orthographic view of the same embodiment, likewise set for straight-ahead travel.

FIG. 3 is a rear orthographic view of the same embodiment, with the steering mechanism set for a right turn.

FIG. 5 is a view of the same embodiment taken from above along the lines 5—5 of FIG. 4, with the case in section, showing the upper part of the internal drive mechanism.

FIG. 6 is a similar view taken along the lines 6—6 of FIG. 4, showing the lower part of the banking mechanism, including the supports, outriggers, and cams.

FIG. 9 is an orthographic view of the cam and one outrigger, of the FIG. 1 embodiment, as they appear with the steering mechanism set for a turn in the direction away from the illustrated outrigger.

FIG. 10 is an orthographic view, partly in section, of the right handlebar and the right hand of the toy rider, of the same embodiment as seen from above.

FIG. 11 is a block diagram, partly schematic, of a radio-control system for the same embodiment.

FIGS. 12, 14 and 16 are front elevations of, respectively, a toy airplane, car and boat which embody our invention—each shown negotiating a left turn.

FIGS. 13, 15 and 17 are side elevations of the same three embodiments as in FIGS. 12, 14 and 16, respectively—but here shown with the steering mechanisms set for straight-ahead travel.

DETAILED DESCRIPTION OF THE PREFERRED EMBODIMENTS

Figure 4:
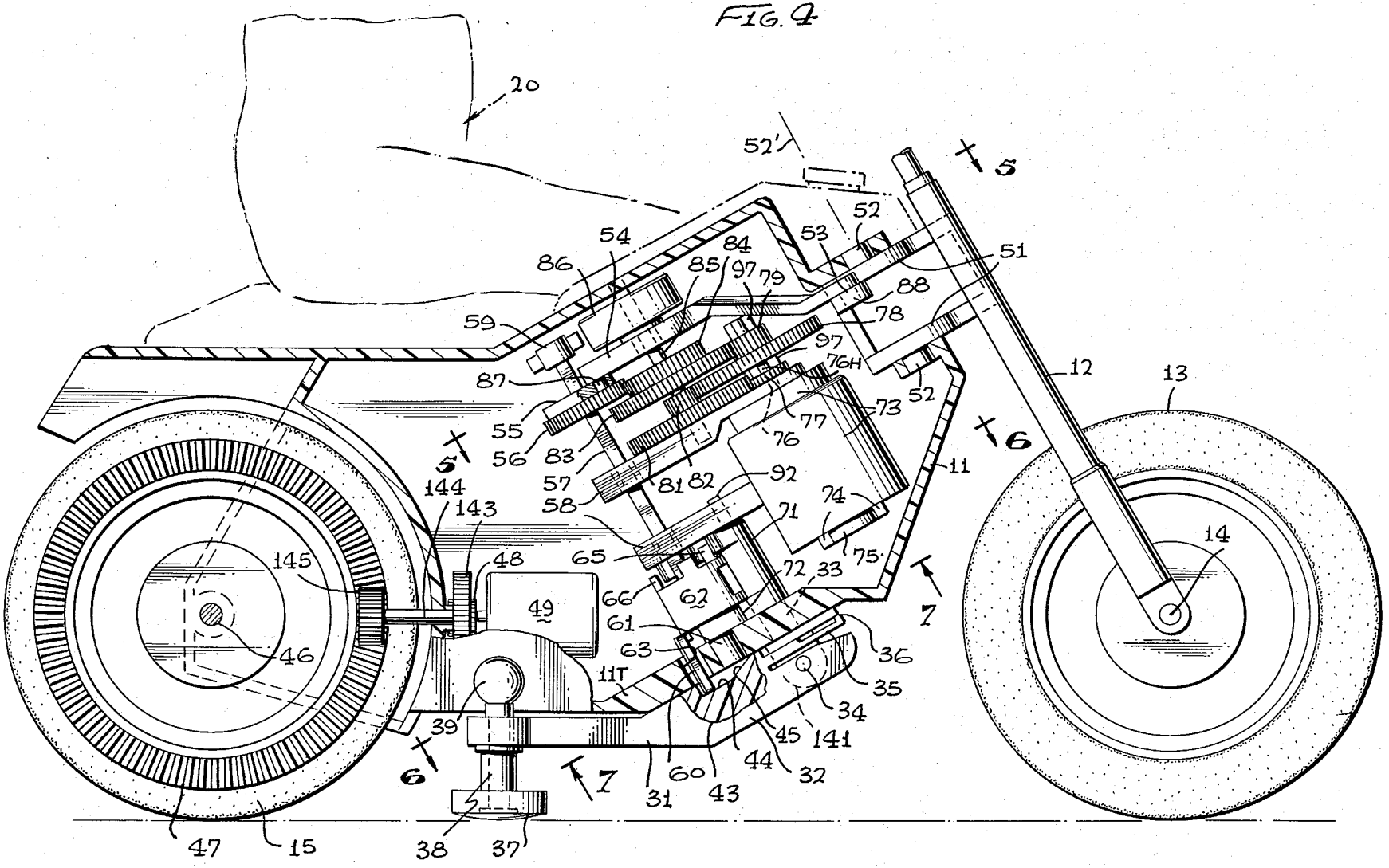
FIG. 4 is a view similar to that of FIG. 1, but partially in section to show the internal mechanism of the FIG. 1 embodiment.

1. Two Wheels in Tandem: A Toy Motorcycle

As shown generally in FIGS. 1 through 3, a preferred embodiment of our invention comprises a frame or casing having a right-side section 11 and a left-side section 11L, a rear wheel 15 mounted to the casing 11, 11L for rolling rotation and driven by a motor 49 (FIG. 4) mounted within the casing, and a front wheel 13 mounted for rolling rotation about axle 14 to steering fork 12, which is in turn rotatably mounted to the frame proper 11, 11L. The toy also has a pair of handlebars 18 and 18L mounted to the top of the steering fork 12, representations of mufflers 16 and 16L, and a radio antenna 17.

The external parts of the casing 11, 11L are configured and colored to resemble a real motorcycle, and the FIG. 20 of a human rider is attached. The upper portion 21 of the FIG. 20 is configured to resemble the torso and head of a rider, and contains the radio receiver and control circuitry 130 through 138 of FIG. 11. For manufacturing convenience the upper portion 21 of the figure is a plug-in unit terminating at its lower end in an electrical connector for functionally interconnecting the control circuitry to batteries housed within mufflers 16, 16L, to the antenna 17, and to the steering motor 73 and the potentiometer 86 (FIG. 4) housed within the casing 11, 11L.

The rider's FIG. 20 is completed by articulated arms and legs. The arms comprise upper-arm sections 22 and 22L, and lower-arm sections 23 and 23L, connected at pivoting joints 28 to each other and to the shoulders of the upper portion 21 of the figure. The lower-arm sections 23, 23L terminate respectively in "hands" (such as the right hand 24), which are coupled to the handlebars 18, 18L in a particular fashion to be described in detail below. The legs of the figure comprise thigh sections 25, 25L and calf sections 26, 26L, connected at pivoting joints 29 to each other and to the ball-type hip joints 29, 29L respectively. The calf sections 26, 26L terminate in "feet" 27, 27L which are coupled at ball joints 39 and 49 respectively to support pillars 38 and 48—which are part of the banking mechanism, explained below.

As already noted, the "mufflers" 16 and 16L are adapted to house dry-cell batteries for powering the various electrical components of the toy motorcycle. As will shortly be seen, where the toy is relatively small, space is at a distinct premium within the casing 11, 11L. Since real mufflers are generally cylindrical, the representations of mufflers 16, 16L offer important space-saving opportunities for placement of the bulky—but generally cylindrical—dry cells. But for this particular novel feature, an additional fairly large housing for the dry cells would be required, adding to the bulk and cost of the unit; such a housing would likely have to be placed high above the wheel axles, substantially and objectionably raising the center of gravity of the entire toy—or, in the alternative, the entire casing or the entire toy would have to be enlarged to accommodate the batteries, substantially and objectionably raising the price. In a toy of this type where turning or "handling" characteristics and low cost are both crucial elements of appeal, housing the batteries in the "mufflers" 16, 16L thus makes a substantial contribution to the success of the overall toy.

An on-off power switch 142 is provided for controlling the connections from the batteries to the motors and electronics.

Supports 37 and 47 are provided at the right and left sides of the toy, respectively. The supports serve to hold the toy up—that is, to prevent it from tipping over and falling onto either of its sides. The right-side support 37 is secured to support pillar 38, which is in turn attached (as previously noted) at ball joint 39 to right "foot" 27 of the rider FIG. 20. However, the support 37 does not hold up the toy by way of the foot 27; as previously mentioned the leg 26, 25 is articulated, and it merely follows the motion of the support 37 with respect to the casing section 11. The action of the support 37 in preventing tipping is by way of the outrigger 31, 32—which is rotatably secured to the support pillar 38 at one end and to the mechanism within the casing 11 at the other end, in the area of pivot 34, in a manner detailed below.

Likewise the support 47 on the left side of the toy is secured by means of support pillar 48 and ball joint 49 to "foot" 27L, and rotatably to one end of the left outrigger 41, 42, which is secured at its other end to the mechanism inside the casing.

Each of the supports 37 and 47 is cylindrically symmetrical, and is mounted for rotation about its centerline with respect to the corresponding outrigger 31, 32 or 41, 42. The rotatability relieves friction during some maneuvers, thereby (1) avoiding a braking effect, which could slow the toy down or even (since the drag may be different on left and right) put it into a spin; and (2) distributing the wear all around the edge of each support, particularly during turns. Other arrangements for rotation of all or part of the supports 37 and 47—such as rotating the supports or an internal part of them about a generally horizontal and transverse axis in the manner of wheels—are also within the scope of our invention.

As shown in FIG. 2, when the toy is in a condition for straight-ahead travel the outriggers 31 and 41 and their corresponding attached supports 37 and 47 are positioned beneath the casing or the feet of the figure, relatively inconspicous but nevertheless functional in holding the toy upright, even while it is moving forward. The outriggers and support pillars and supports are so dimensioned in relation to the configuration and dimensions of the casing 11, 11L, steering fork 12 and wheels 14 and 15 so that at least one of the supports 37, 47 is in contact with the surface on which the toy rests, the other support being at most very slightly out of contact with the surface—assuming a planar surface.

Ideally the supports 37, 47 should both be in grazing contact with the surface, but in a low-cost production context it is not feasible to ensure such a relationship, and it is more essential to be certain that the rear wheel will always be in contact, for traction, and the front wheel will always be in contact, for steering. Therefore in practical production toys it is to be expected that one of the supports will be supporting the toy, at any chosen moment, and the other will be slightly elevated. Since the elevation is only very slight, it is disregarded in the illustrations; and the centerline 19 of the toy may be regarded as substantially vertical.

As shown in FIG. 3, when the toy is in a condition to negotiate a turn the outriggers and attached supports move. In a right turn, as shown, the right-side support 37 rises, and the left-side support 47 descends, relative to the casing 11, 11L. The result is to lean the toy—that is, to move its centerline to the position 19, angled substantially with respect to the vertical 10. Accordingly the right-side support 37 is also extended away from its previously shown position, to a position beyond the center of gravity of the leaning toy. Thus while left support 47 operates to tilt the toy toward the right, the right support 37 operates to (1) permit the toy to tilt without losing wheel contact with the surface, and (2) prevent the toy from tipping over onto its right side.

These various motions of the supports 37 and 47 are effected by a banking mechanism which includes the outriggers 31, 32 and 41, 42—as well as apparatus (to be described) within the casing 11, 11L, for orienting the outriggers.

The banking mechanism is so dimensioned as to continue the previously described relationship: both wheels remain in contact with the surface on which the toy is operating, and at least one of the supports normally remains in contact with the surface, the other support being at most slightly out of contact with the surface—still assuming a planar operating surface.

Of course if the toy is made to assume this banked orientation while it is standing still or moving very slowly, its weight will be on the right-side support 37, and it will be the left-side support 47 which is possibly out of contact with the operating surface. However, if the toy is rolling quickly forward while in the banked orientation, with the steering fork correspondingly turned to the right, it will be going through a right turn—generating centrifugal force directed leftward (that is, toward the outside of the turn), which will tend to overcome the force of gravity downward onto the right-side support 37.

When the speed is sufficient, centrifugal force will in fact exceed that of gravity and place the weight of the toy on the left-side support 47, so that it will be the right-side support 37 which is possibly out of contact with the operating surface. However, since the toy is in actuality banked for the turn, it will not tip over toward the left unless a combination of very rapid forward speed and very sharp turning radius is used. If desired the toy can be designed to limit speed and/or turning radius, or the two in interactive combination, to entirely prevent tipping over on a planar operating surface.

In principle there is also an intermediate angle of banking at which the leftward centrifugal force just balances gravity. Under these circumstances it is possible for both supports to be slightly out of contact with the operating surface—or, depending upon design details, tolerances, and wear of mechanical parts, for both supports to be in grazing contact. In such a condition the supports are not really operative to hold up the toy, since it is balancing itself; but obviously the toy will not usually or principally operate in this way.

Of course when the toy negotiates a turn to the left, the operation of the outriggers 31, 41 and supports 37, 47 is reversed, to bank the toy so that its centerline moves to the position 19L of FIG. 3.

The foregoing operation is achieved by mounting each outrigger for rotation about two mutually perpendicular axes. One of these axes is horizontal, as represented by the pin 34 shown in FIG. 1, about which the right-side outrigger 32, 31 rotates. Each outrigger rotates about its horizontal axis when it is lowering the corresponding support on the outside of a turn—as 47 in FIG. 3. The other axis is at some nonzero angle to the vertical, as represented by the axis of rotation 33' (FIG.

1), which is approximately 30° from the vertical. It is to accommodate this angle that the outriggers are formed in two sections: a horizontal section such as 31, following the horizontal undersurface of the casing 11, and an angled section 32, following a suitably angled section 11T (FIG. 4), to which the axis of rotation 33' is normal. By virtue of the angled section 32 of the right outrigger, the correspondingly angled undersurface 11T, and the correspondingly angled outrigger axis of rotation 33', when the outrigger swings outward (e.g., outrigger 31, 32 to the right) it also swings upward.

In this way both the functions of the "inside" outrigger previously described are accomplished with a single, simple rotary motion. In our preferred embodiment each outrigger's nonhorizontal axis (e.g., outrigger axis 33') is parallel to the principal longitudinal plane of the toy—which is to say, parallel to the plane of the rear wheel.

While the outrigger on the outside of each turn is actuated downward, bot outriggers are continuously urged upward toward the mating undersurfaces of the casing by the action of integral springs (e.g., 35 in FIG. 1) against rectangular flange 36, which rotates with the corresponding outrigger (e.g., with outrigger section 32 in FIG. 1).

The details of the steering mechanism are illustrated in FIGS. 4 through 9. The relationship between the steering and banking mechanisms is shown perhaps most clearly in FIG. 8. There the source of power to operate both of these mechanisms is the dual drive gear 84/83 (which in turn draws power from an electric motor 73 through a gear train 77 to 82 as shown in FIG. 4). The upper gear 84 of the integral dual gear 84/83 drives mating spur gear 56, which has a raised hub 55. The hubbed gear 55 is coupled by a pin 87 (FIG. 4) embedded vertically in the top of the hub to a coupling arm 54, whose other end is likewise coupled by a pin 88 to steering lever 53 of the steering-fork body 51.

The steering-fork body 51 rotates about pins 52 which are journalled in the left-side casing 11L as shown in FIG. 4. The bifurcated steering fork 12, 12L is releasably clamped to the forward part of the steering-fork body 51 (FIG. 5). Thus application of driving power to rotate drive gear 84 counterclockwise will rotate mating gear 56 clockwise, pulling coupling arm 54 and steering lever 53 backward, thereby rotating the steering-fork body 51 (and with it the steering fork 12 and the front wheel 13, with its axle or axis of rotation 14) clockwise—thereby causing the motorcycle to negotiate a right turn. The hub 55 on gear 56 helps to keep the coupling arm 54 away from the teeth of gear 56, to prevent binding or damage to the coupling arm.

Figures 7, 8:
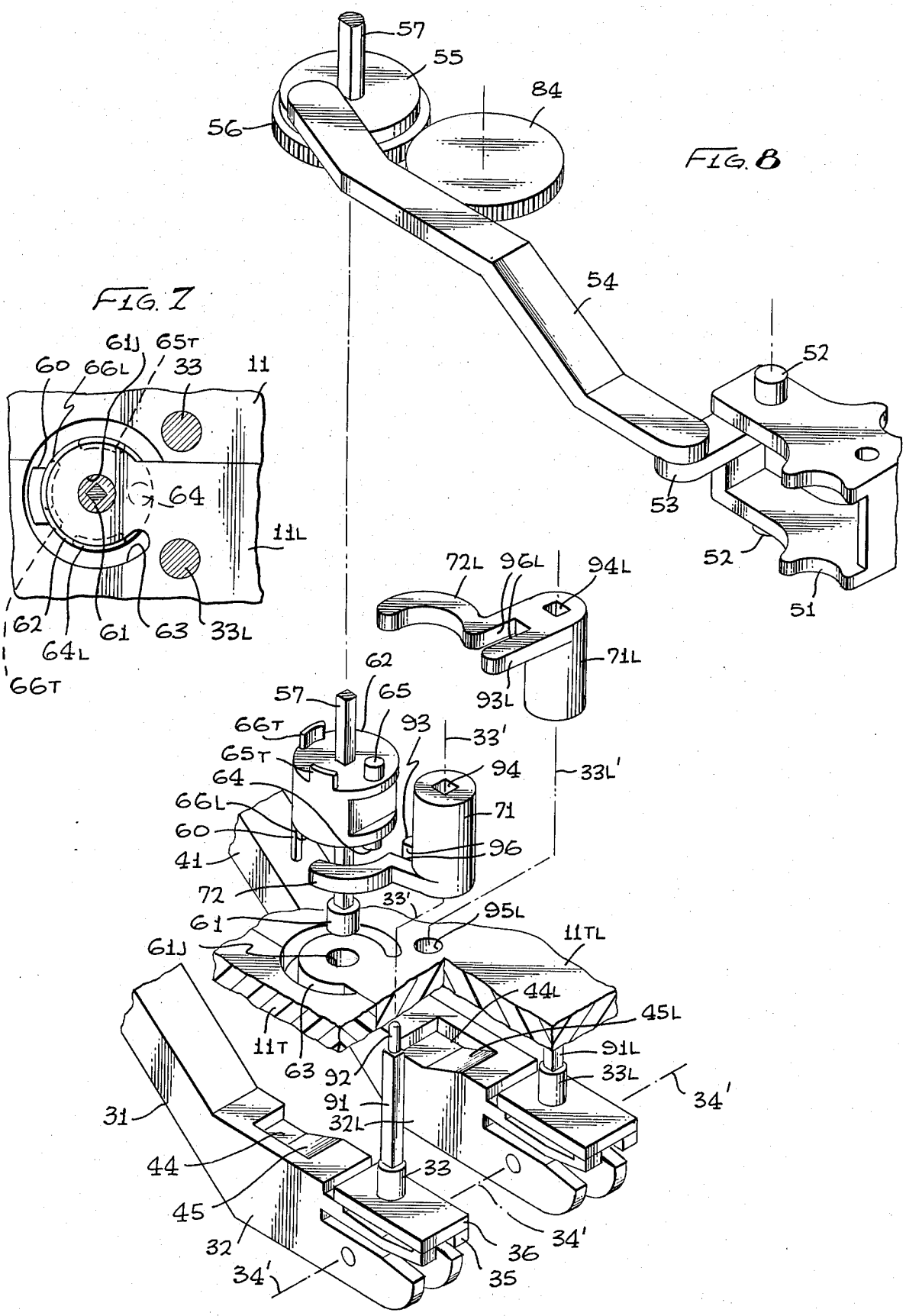
FIG. 7 is a bottom view of the case in the same area so that covered by FIG. 6, showing in orthographic projection the relationship between the cams and one pair of axes about which the outriggers operate when actuated by the cams.
FIG. 8 is a perspective view of the banking mechanism in combination with the final stages of the steering mechanism, and that mechanism's coupling to the steering fork, with the steering mechanism set for straight-ahead travel.

The gear 56 is keyed to the shaft 57, whose lower end is square and carries a bushing 61 journalled into a mating hole in the left side of the casing 11L. Mounted to the square portion of shaft 57 just above bushing 61 is a cylindrical cam body 62, carrying matching cam pins 65 and 64 on its upper and lower surfaces, respectively, and a two-edged cam 60 which stands out beyond the cylindrical surface of cam body 62 and extends downward well below its lower surface. The two-edged cam 60 protrudes through a circular-segment slot 63 in the bottom of the casing, at sections 11T and 11TL (FIGS. 7 through 9). Below the casing, the cam 60 engages inclined-plane cam-follower surface 45 or 45L, depending on the direction of turn, to force corresponding outrigger arm 32 or 32L downward—so as to force the casing section 11T or 11TL, respectively, upward on the outside of a turn.

Meanwhile the cam surface provided by pin 65 or 64 on the cam body 62 pushes outward on cam follower 96L or 96, respectively, so that the respective cam-follower body 71L or 71 is rotated—clockwise in the case of 71L, counterclockwise for 71. The actuated cam-follower body in turn rotates the corresponding square shaft 91L or 91 to which it is fitted, and thereby the corresponding attached outrigger arm 32L or 32, in the same direction. Thus the cam surfaces on cam body 62 force the outrigger on the inside of a turn to swing away from the casing (and upward, as previously explained), to permit banking without removing either of the wheels 13, 15 from the operating surface, and to properly support the toy beyond its center of gravity as shifted by the banking action.

Continuing the example previously begun with respect to the steering-fork actuation, driving gear 84 counterclockwise (to produce a right turn) will operate gear 56 clockwise, cam body 62 clockwise, lower cam pin 65 against cam follower 96 to rotate shaft 91 and the attached outrigger 32, 31 and support 37 outward and upward about its shaft 91 and bushing 33, shown in FIGS. 6 and 8—or in other words about its outrigger axis 33' as shown in FIG. 3. The right-side outrigger axis 33' is nonhorizontal, and it is also as previously noted at a substantial angle to the vertical.

The same clockwise action of cam body 62 also drives cam 60 clockwise (as viewed from above) so that its left-side cam surface actuates inclined-plane cam-follower 45L, pushing the left-side outrigger 32L, 31L downward about the horizontal axis 34', to the position shown in FIG. 3.

When cam pin 64 operates against cam follower 96, a keeper arm 72 swings toward the right side 11 of the casing. As the outrigger approaches its maximum travel away from the casing (for a turn of minimum permissible radius), the keeper arm 72 impinges against the inside of the casing 11, preventing overtravel of the mechanism. Cam tab 64L on the underside of cam 62 prevents the cam follower 96 from swinging back toward its FIG. 6 and FIG. 8 position without waiting for the cam pin 64—which if not prevented would result in the pin 64 "losing" the follower slot 96, and the attached outrigger 31, 32 thus losing its functional connection to the steering mechanism.

Meanwhile the keeper arm 72L on the top of the cam body 62 is restrained between the shaft 57 and the retaining surface provided by upstanding tab 66T formed along the upper, outer rim of the cam body 62. In this way the left-side outrigger 32L is prevented from swinging outward, out of reach of the necessary actuation by cam 60 already described.

When the toy makes a left turn, all of the foregoing exemplary description is reversed, left for right and clockwise for counterclockwise. In this connection, the lower arm 72 is restrained between the shaft 57 and tab 66L on the bottom of the cam 62. Cam tab 65T on the top of cam 62 prevents cam follower 96L from swinging back.

On each side the cam-follower body 71 or 71L rotates with the corresponding outrigger 32, 31 or 32L, 31L about the respective angled-to-the-vertical axis 33' or 33L'. This rotation is approximately proportional to the rotation of the steering fork 12, being related by the coupling through steering-fork body 51, the lever 53, coupling arm 54, gear hub 55, shaft 57, cam body 62, cam pin 64 or 65, and cam-follower 96 or 96L. It will be understood that the action of the cam pins 64 and 65 against the corresponding cam followers 96 and 96L produces a relationship between the rotation of the cam shaft 57 and the rotation of the outrigger shaft 91 or 91L which is not precisely proportional, but roughly so.

Likewise on each side the cam follower 45 or 45L is actually formed on the surface of, and so of course rotates with, the corresponding outrigger 32, 31 or 32L, 31L about that outrigger's respective horizontal axis. In our preferred embodiment the horizontal axes of the two outriggers are in mutual alignment, and so are represented as in FIG. 8 by a common horizontal axis 34'. While this in an advantageous configuration it is not absolutely required; the two horizontal axes in a different design might not be aligned. The cam 60 and the cam pins 64 and 65 rotate with the shaft 57, and so in proportionality to the rotation of the steering fork 12.

The relationship of three axes of the camming mechanism is illustrated in FIG. 7, a view from the bottom of the casing 11, 11L. The shafts 33 and 33L continue into the outriggers beneath the case, and so appear in section. The square shaft 57 is shown with its bushing 61, journaled into the case section 11L at aperture 61J (FIGS. 7 and 8).

By considering FIGS. 8 and 9 together it may be seen that the two-sided cam 60 makes approach to the inclined-plane cam follower 45 (on the right side) or 45L (on the left) by first traversing flat entry portion 44 or 44L of the outrigger upper surface, so that the camming force is applied more nearly parallel to the long axis of the outrigger; this minimizes the tendency for the outrigger to be forced outward, against the action of the retaining surfaces and keeper arms mentioned earlier. Connection between each outrigger and its corresponding cam-follower shaft 33 or 33L is made by means of an end-tab 141 or 141L, which fits in a slot defined in the forward end of the corresponding outrigger, as may best be seen by considering FIGS. 4 and 8 together. The corresponding spring 35 or 35L too is slotted to accommodate the end-tab 141 or 141L.

The geometry of the outward-swinging action of the outriggers is shown clearly in FIG. 6. From this view as well as those previously discussed it may be seen that the cam-follower bodies 71 and 71L each have dual cam followers 96 and 96L. That is to say, the cam pins 64 and 65 ride into cam-follower slots 96 and 96L, respectively, in the corresponding cam-follower arms; and each pin pushes against one side of one of these slots when initiating a banking maneuver. (The cam-follower arms are configured so that the other pin misses engaging its corresponding slot.)

However, when the turn is over and the banking is to be canceled, the cam body 62 rotates back to the on-center position and the same pin 64 or 65 which began the maneuver now pushes against the opposite side of the same slot, to restore the outward-swung outrigger arm to its original position. Thus the outrigger section 31 or 31L swings to the position 31' or 31L' (FIG. 6) respectively as the corresponding pin 64 or 65 operates against one side of the corresponding slot 96 or 96L; and then swings back to the rest position as the pin 64 or 65 operates the other side of the same corresponding slot 96 or 96L.

The various forces and torques present in the camming mechanism and transmitted by it to the outriggers must be absorbed by the frame or casing without deformation; for this reason an extra-thick section 11T, 11TL (FIGS. 4, 8 and 9) of the casing is provided in the area where the camming-mechanism shafts are journaled and the actuation of the outriggers takes place.

The steering and banking mechanism just described is powered by electrical motor 73, which in turn receives power from dry cells (not shown) and is controlled by the radio receiver and associated circuitry. The motor 73 is mounted to the casing section 11L by yokes 74 and 58 integral with the casing. The yokes 58 also accommodate and stabilize the shaft 57, previously discussed, and the shaft 85, to which is keyed the drive gear 84/83 previously mentioned and on which there are several other components now to be discussed.

The motor 73 drives a shaft 76 on which is keyed a pinion 77. Pinion 77, driven by the motor 73, in turn drives spur 81, which with its integral pinion 82 freewheels on shaft 85. The pinion 82 drives spur 78, which with its integral pinion 79 freewheels on a hollow shaft 76H. This hollow shaft is aligned with the smaller-diameter motor shaft 76 and mounted to the left-hand frame section 11L by yokes 97.

Pinion 79 drives the lower gear 83 of the integral gear pair 84/83, previously mentioned, whose upper member drives the rest of the steering and banking mechanisms as already described. Since the integral gears 84 and 83 are fitted to the keyed shaft 85, they also drive the wiper 135 (FIG. 11) of potentiometer 86. The potentiometer is part of the control electronics, to be described shortly. By the use of the multistage reduction gear train just detailed, the motor speed is brought down by a factor of about 110 (to the cam shaft 57) to a suitable steering-adjustment rotational speed for both the steering fork and banking mechanism.

Motor 49 is supported from the left-side frame section 11L, and when actuated by the remote-control circuitry drives a pinion 48, which in turn actuates a spur gear 143. The spur 143 and a secondary drive pinion 145 are keyed to a common shaft 144 which is suitably supported from the right-side frame section 11. The secondary pinion 145 engages the teeth of a ring gear 47 formed on the side of the rear tire 15, to propel the toy vehicle forward.

Another view (FIG. 5) of the upper portion of the steering and steering-power systems shows the relationship between the steering fork 12, 12L, the steering-fork body 51, steering lever 53, coupling arm 54, partial gear train 78 through 84 and 56, and the casing 11 and 11L.

When the steering fork 12 is turned by this mechanism, the handlebars 18 and 18L of course follow the fork, and the articulated arms 23, 22 and 23L, 22L follow the handlebars. The distances between the handlebars 18 and 18L and the respective shoulders of the FIGURE change with angle of the steering fork 12. Therefore as the steering fork 12 rotates there are also changes in the angles assumed at joints 28 (FIG. 1) by the two arm sections with respect to the torso and to each other. Accordingly the elbows of the FIGURE are slightly lower and further back on the inside of a turn, and slightly higher and further forward on the outside. These changes in elevation may be seen in FIG. 3. In short, the articulation of the FIGURE accommodates the change in distance.

However, in addition to the change in distance there is a change in the angles made in the roughly horizontal plane between the handlebars 18 and 18L and the respective forearms 23 and 23L. The angle on the inside of the turn increases, while the angle on the outside of the turn decreases. This change of angle cannot be accommodated by the articulation already described. It could be accommodated by an additional articulation permitting pivoting of the hands 24, 24L in the horizontal plane—either within the hand or at the wrist—by ball joint or tongue and groove, or other hinge, or by a flexible element; however, these alternatives are all relatively expensive. A very inexpensive solution would entail providing a generally horizontal wide groove within each hand, wide enough to accept the handlebars at any of the angles which occur within the range of operation of the handlebars. However, this solution is objectionable in that the hands would appear to grip the handlebars very loosely fore-to-aft—so much so that when the handlebars rotated they would visibly slide backward and forward within the hands, destroying the illusion of the hands moving the bars.

Our invention provides in a preferred embodiment a configuration of the hands which accommodates the change of angle with a realistic appearance and at very low added cost. As shown in FIG. 10, the right-side handlebar 18 passes through a shaped slot 101, 102 in the hand 24 at the end of the right forearm 23 of the toy rider. The slot consists of two generally frustoconical portions 101 and 102, which are joined at their smaller ends near the center of the hand, and expand outwardly toward opposite sides of the hand. The portions 101 and 102 are generally flattened to just the height necessary to slidingly accommodate the handlebar, as shown in FIG. 1. The width of the slot at the plane of intersection of the two generally frustoconical shapes need be only slightly greater than the handlegrip diameter, to permit the handlebar to rotate within the compound slot over the entire range of angles encountered in operation of the steering fork. Therefore the fore-to-aft play is reduced to that slight excess, maintaining a realistic appearance while accommodating the steering rotation.

The remote-control system is a generally conventional radio type. Control of the propulsion motor is entirely conventional and will not be discussed. The steering system is diagrammed in FIG. 11. The user manipulates a direction handle (such as miniature handlebars 151 similar to those on the toy itself) on a suitable control console 156 having appropriate indica 153. The mechanical motion of the handle is transmitted at 152 to the wiper 121 of a potentiometer winding 120 within the console 156. The resulting variable electrical signal controls operation of a pulse modulator 122, whose output at 123 modifies the operation of radio-frequency transmitter 124. The modified output of the transmitter proceeds at 125 to transmitting antenna 126, whence radio signals 127 are broadcast. Normally modulator 122 and transmitter 124 are also housed within, and the antenna 126 mounted to, the console 156.

The receiving antenna 17 (also see FIG. 1) in the toy intercepts some of these signals and directs them at 129 to the radio-frequency receiver 130. The amplified output of the receiver passes at 131 to a pulse detector 132 which produces at 133 a voltage proportional to that picked off from potentiometer winding 120 by wiper 121. The proportional voltage 133 enters a comparator 134, which operates to force a wiper 135 to pick off yet a third proportional voltage from potentiometer winding 136. The comparator 134 accomplishes this by comparing the voltage at the input 133 with that from the wiper 135 in a bridge type of circuit, actively processing the difference signal to obtain desired dynamic response, and directing a suitable compensation signal at 137 to a power driver circuit 138. The latter circuit provides a proportional signal 139 of suitably lowered impedance to power the motor 73 (also see FIG. 4).

The resulting mechanical motion of the motor shaft is directed at 154 to the steering and banking mechanisms, as described with reference to FIG. 4. The mechanical motion is also picked off at 155 to drive the balancing wiper 135 along the potentiometer winding 136 of potentiometer 86 (FIG. 4), in such a direction as to reduce the processed difference signal 137 to zero. The general effect of this system is to force the wiper 135 to assume a position along the winding 136 which tracks the position of the wiper 121 along the winding 120 in the control console. In the course of doing so the system of course forces the steering fork 12 to assume an angle which tracks the angle of the control handle 151 on the console 156.

While we prefer a null-balance system of this type, it will be apparent that a simpler system, requiring considerably greater skill on the part of the user, could be employed in which the user's manipulation of a handle was transmitted to the toy for direct control of the steering motor itself, rather than the steering angle. In such a system the "feel" of turning the handlebars would of course be lost.

The banking mechanism of the two-tandem-wheel embodiment of our invention could be equally effective in providing realistic-appearing operation of a toy airplane, spaceship, submarine or other craft, even a totally fanciful one, without departing from the scope of our invention. For example, in a toy airplane the two tandem wheels could be almost completely concealed beneath and within a toy fuselage, and the outriggers could be configured as landing gear. In such a toy the lateral swinging of the outriggers could be omitted if preferred, leaving only vertical rocking action with the supports in a typical landing-gear position.

Articulation of the rider figure is not required; telescoping of pliable limbs accommodating the relative motions of the steering fork would be equally within the scope of our invention though we prefer the realism provided by the articulation. On the other hand, it is not required to limit the rider configuration to one resembling a human rider: comical or fantastic riders having the appearance of animals or imaginary creatures may be substituted; nor is the concept limited to four-limbed creatures, as a droll or fantasy effect may be obtained with an insect, spider or octopus, or imaginary multilimbed creature, riding a two-tandem-wheel toy vehicle.

2. Tiltable Frame: A Toy Airplane

Much simpler mechanisms may be used for steering-responsive automatic banking of toys which have two wheels side-by-side.

For example, the toy airplane of FIGS. 12 and 13 has an undercarrige comprising struts 212, with wheels 211 mounted side-by-side to the ends of the struts. Carried on the undercarriage 212 is the front part of the frame 214, which is configured as (or has fitted to it) a toy airplane fuselage, with wings 215 and 216, a propeller 217, horizontal and vertical stabilizers 221, and pilot figure 218. The rear part of the frame 214 is carried by a support 222, which if desired may have mounted to it a third wheel (not shown). The toy airplane has a steering mechanism which may cmprise the rear support 222 (with or without a third wheel mounted to it), or may comprise part of the mechanism 213; so that either the support 222 or the undercarriage 212 may be angled with respect to the longitudinal axis of the fuselage, to cause the vehicle to negotiate turns.

The third-point support 222, with a wheel mounted to it, may if preferred be place forward of the side-by-side wheels 221, under the airplane nose, as is the case with larger aircraft. In this case of course the wheels 211 must be moved aft of the plane's center of gravity. In this case it would be more natural to steer with the nose wheel, though it would in principle still be possible to steer with the two side-by-side wheels.

The mechanism 213 responds to the operation of the steering mechanism (whether the latter comprises rear support 222 or another part of the mechanism 213, or both) by tilting the frame 214 and attached components with respect to the undercarriage 212 —that is to say, about the rotational axis 219 shown in FIG. 13. The mechanism is configured to tilt the frame downward on the inside of a turn. For example, in FIG. 12 it is assumed that the airplane is making a left turn, so that arrow 231 represents the direction toward the inside of the turn; left wing 216 is lowered and right wing 215 is raised, as shown, to simulate the banking of an aircraft in a turn. For additional effect, if desired, the ailerons 216A, elevators 221E and rudder 221R may also be functionally connected to operate in response to the steerng mechanism in an appropriate fashion.

The relatively simple frame-to-undercarriage tilting system described here is not to be confused with the airplane-banking system described in part 1 of this disclosure, wherein the vehicle is supported on two tandem wheels and banked by an outrigger system similar to that used for the toy motorcycle.

The system of FIGS. 12 and 13 can be used in a one or four-wheel vehicle, as well as a two- and three-wheel vehicle. For example, by duplicating the undercarriage arrangement at both ends of a vehicle, even if one of the frame-to-undercarriage tilting mechanisms is merely free to follow the tilting mechanism at the other end of the vehicle, the entire vehicle frame will be tiltable to left or right in response to the steering mechanism. This system could be used with a toy boat, with the wheels as nearly as possible concealed under the boat body, or with a toy car. In the case of a car, either the wheels could be simply left visible, so that only the car body would appear to rock outward in a turn, or the wheels could be concealed as well as possible beneath the car body—and separate dummy wheels provided to give the appearance of a real car's wheels. Th dummy wheels may if desired be suspended compliantly or on hinged axles so as to follow the operating surface to some extent. Similarly, so long as there is at least three point support, two or more supports might be runners while at least one support is a steerable wheel.

3. Lifting Wheels: A Toy Car and a Toy Boat

Mechanisms of intermediate complexity (between the system of FIGS. 1 through 11 and the system of FIGS. 12 and 13) may be used for steering-responsive banking of toys which have at least three-point support. Such mechanisms of intermediate complexity provide very startling and amusing effects. Again, as long as there is at least three point support, there might be one or more steerable wheels, with the other supports being runners.

For example, the toy car of FIGS. 14 and 15 has a frame 317, front wheels 311 and 312, rear wheel 319, a right rear wheel not visible in the views, and driver figure 318. A steering mechanism comprising the axles supporting front wheels 311 and 312 is provided for causing the vehicle to negotiate turns. A banking mechanism comprises rollers 321 and 322, corresponding levers 313 and 315, and respective independently operable lever-rotating means 314 and 316.

The lever-rotating means operate one or the other of the levers 313 and 315 to engage the corresponding roller 321 or 322 against the supporting surface —at such an angle as to raise the corresponding wheel pair 312/319, or 311 and the unillustrated right rear wheel, out of contact with the supporting surface. For example, in the case of a left turn as assumed in FIG. 14, so that arrow 331 points toward the inside of the turn, mechanism 314 operates lever 313 downward so that roller 321 engages the supporting surface. The turn continues, on the two right-side wheels and the roller 321, with the two left-side wheels 312 and 319 in the air. The same mechanism would be appropriate for toy vehicles intended to suggest other four-wheel land vehicles, such as trucks, jeeps, fantasy vehicles for wheeled land travel, and the like.

The boat of FIGS. 16 and 17 is very nearly identical in function to the car of FIGS. 14 and 15, the correspondingly numbered parts being similar. In the case of the boat, however, the wheels are as nearly as possible concealed within the hull 417, and the operation of the banking mechanism is exactly the opposite of that in FIGS. 14 and 15. Specifically the boat leans toward, rather than away from, the direction 431 of the inside of the turn. For a left turn, for instance, as shown in FIG. 16, the left-side lever-operating means 416 operates lever 413 downward so that roller 422 engages the supporting surface. The turn continues, on the two left-side wheels 412 and 419, with the two left-side wheels 411 and the unillustrated right rear wheel both in the air.

It will be apparent that a lever system such as that of FIGS. 16 and 17 could be used in an airplane-type vehicle as well as a boat. Various other types of craft whose real counterparts are nonsolidly-supported in operation may also be combined with the inward-banking system of FIGS. 16 and 17. By craft which are nonsolidly supported we mean to include watercraft such as submarines and ships; aircraft such as planes, airborne rockets, or even hang gliders; and spacecraft (though the real counterparts of such craft may not actually bank in operation) or fantasy craft. Such craft may also be combined with the simpier tilting system of FIGS. 12 and 13.

4. Conclusion

While the principles of our invention have been exemplified with reference to particular preferred embodiments, it is to be understood that a great many variations are encompassed within the scope of our invention.

For example, the banking systems of our invention need not be incorporated into toys which are self-propelled, or in which the steering mechanism is internally energized; a gravity-powered toy is also within the scope of the invention. Such a toy could have single-setting steering and banking, or could have a mechanically programmed steering and banking routine.

Further, the banking angle need not be made generally proportional or even a monotonic function with respect to the steering angle: a toy operating similarly but with only one or two angles of lean, and nearly step-function operation between those angles and the upright position, would be relatively crude but nevertheless within the scope of our invention.

In a self-propelled vehicle, remote control of the propulsion system is not central to our invention; and where it is provided, continuous control is not an absolute requirement—though obviously we prefer to provide it.

Likewise a great number of propulsion systems may be used within the scope of our invention, in place of the torqued-wheel arrangement disclosed above for the motorcycle. For example, any of the vehicles could employ propelling means which by an independent small driving wheel or reciprocating push-pad apply driving force directly to the stationary surface on which the toy is operating; or could be driven aerodynamically by a propeller, by jet or even by rocket.

Similarly propulsion means such as a wind-up spring, or even a real internal-combustion engine, could be employed in practicing our invention. The radio-control system is preferred for obvious reasons, but less expensive umbilical-cable systems, either electrical or mechanical, could be substituted.

All of the foregoing is intended as exemplary only and not to limit the scope of our invention, which is to be determined only by reference to the appended claims.

I claim:

1. A toy vehicle for operation on a supporting surface, the vehicle comprising:
   a frame;
   a wheel mounted to the frame;
   a steering mechanism, supported on the frame, for causing the vehicle to negotiate turns;
   an additional wheel mounted to the steering mechanism so that the wheels are generally one in front of the other;
   a pair of side supports mounted to the frame, one on each side, each support being moveable from a first position adjacent to the frame to a second position spaced outwardly from the frame, said supports for engaging such supporting surface to prevent the vehicle from falling over sideways;
   means on the frame for moving said supports inwardly and outwardly in coordination with the steering mechanism such that during a turn the support on the inside of the turn is moved toward its second position spaced outwardly from the frame and the support on the outside of the turn is maintained in its first position adjacent to the frame; and
   banking means responsive to the steering mechanism and operatively associated with each support for tilting the vehicle during the turn toward the inside of the turn.

2. The vehicle of claim 1, also comprising means for propelling the vehicle.

3. The vehicle of claim 2, also comprising:
   means for remote control of the steering mechanism and propelling means;
   whereby the vehicle may be maneuvered through turns in either direction by remote control, automatically banking toward the inside of each turn.

4. The vehicle of claim 1, wherein the banking means operate in such relation to the steering mechanism that, within the range of operation of the mechanism, the vehicle banks at a greater angle for turns of smaller radius.

5. The vehicle of claim 4, also comprising means for propelling the vehicle.

6. The vehicle of claim 5, also comprising means for remote control of the steering mechanism;
   whereby the vehicle may be maneuvered through turns in either direction at variable turning radius by remote control, automatically banking toward the inside of each turn to an extend corresponding with the turning radius.

7. The vehicle of claim 6, also comprising means for remote control of the propelling means;
   whereby the vehicle may be so maneuvered at variable speed by remoted control.

8. The vehicle of claim 7, wherein the turning radius and speed are both continuously variable by the remote control means.

9. The vehicle of claim 8, wherein the propelling means apply torque to one of the wheels.

10. The vehicle of claim 8, wherein the propelling means apply force to a stationary surface.

11. The vehicle of claim 8, wherein the propelling means comprise a rotating aerodynamic propeller.

12. The vehicle of claim 8, wherein the propelling means release compressed gas.

13. The vehicle of claim 8, wherein the propelling means comprise a wind-up spring.

14. The vehicle of claim 8, wherein the propelling means comprise an electrical motor.

15. The vehicle of claim 14, wherein the propelling means also comprise an electrical battery.

16. The vehicle of claim 8, wherein the propelling means comprise an internal combustion engine.

17. The vehicle of claim 8, wherein the remote control means comprise:
   a radio receiver mounted to the vehicle; and
   a separately housed radio transmitter.

18. The vehicle of claim 8, wherein the remote control means comprise:
   a separately housed control console; and
   a control cable interconnecting the console and the vehicle.

19. The vehicle of claim 17,
   externally configured to resemble a motorcycle and comprising the figure of a rider astride the motorcycle;
   the radio receiver being positioned within the body of the figure.

20. The vehicle of claim 1,
   externally configured to resemble a motorcycle; and
   comprising the figure of a rider astride the vehicle, two extremities of the figure being attached respectively to the two side supports and adapted to accommodate the movement away from the frame of the side support which is on the inside of a turn by swinging away from the frame with the support.

21. The vehicle of claim 1, wherein said banking means also lowers the side support which is on the outside of a turn and raises the side support which is on the inside of the turn, relative to the frame.

22. The vehicle of claim 21,
   externally configured to resemble a motorcycle; and
   comprising the figure of a rider astride the vehicle, two extremities of the figure being attached respectively to the two side supports and adapted to accommodate the respective lowering and raising of the side supports.

23. The vehicle of claim 22, wherein the said extremities of the figure are articulated to suggest the skeletal articulation of a rider.

24. The vehicle of claim 23, wherein the figure is so formed and the extremities so articulated as to suggest a human rider and such a rider's legs.

25. The vehicle of claim 22, wherein the said extremities of the figure are pliable.

26. The vehicle of claim 25, wherein the figure and the said extremities are so formed as to suggest a human rider and such a rider's legs.

27. The vehicle of claim 22, comprising transverse handlebars coupled to respond to the steering mechanism; and wherein two other extremities of the figure are attached respectively to the left and right ends of the handlebars, and adapted to accommodate the motion of the handlebars in response to the steering mechanism.

28. The vehicle of claim 27, wherein the said two other extremities of the figure are articulated to suggest the skeletal articulation of a rider.

29. The vehicle of claim 28, wherein the figure is so formed and the said other extremities are so articulated as to suggest a human rider and such a rider's arms.

30. The vehicle of claim 29, wherein the arms of the figure are attached to the handlebars in such a way as to accommodate variations in the angle between the axis of each arm and the axis of the corresponding handlebar while maintaining generally firm-appearing attachments and presenting the appearance of hands gripping the handlebars.

31. The vehicle of claim 30, wherein:

each arm of the figure defines a generally horizontal slot, at the location of the figure's corresponding hand;

said slot being formed as two generally frustoconical portions which are joined at their smaller ends intermediate the sides of the hand and expand outwardly toward opposite sides of the hand, said generally frustoconical portions being generally flattened; and the handlebar on each side passing through the joined smaller ends of the frustoconical portions.

32. The vehicle of claim 27, wherein the said two other extremities of the figure are pliable.

33. The vehicle of claim 32, wherein the figure and the four extremities are so formed as to suggest a human rider and such a rider's arms and legs.

34. The vehicle of claim 1, wherein the supports are rotatable with respect to the banking means, whereby in a turn friction is reduced between at least one support and such supporting surface.

35. In a radio-controlled toy motorcycle having a frame, a wheel mounted to the frame, a steering mechanism mounted to the frame for causing the toy to negotiate turns, an additional wheel mounted to the steering mechanism so that the wheels are generally one in front of another, propulsion means for driving one of the wheels, and a radio receiver for controlling the steering mechanism and propulsion means, the improvement comprising:

a support mounted on each side of the frame, to prevent the toy motorcycle from falling onto either of its sides, each support being moveable from a first position adjacent to the frame to a second position spaced outwardly from the frame;

means on the frame for moving said supports inwardly and outwardly in coordination with the steering mechanism such that during a turn the support on the inside of the turn is moved towards its second position spaced outwardly from the frame and the support on the outside of the turn is maintained in its first position adjacent to the frame;

banking means responsive to the steering mechanism and operatively associated with each support for tilting the vehicle during the turn toward the inside of each turn.

36. The vehicle of claim 35, wherein said banking means also lowers the side support which is on the outside of a turn and raises the side support which is on the inside of the turn, relative to the frame.

37. The vehicle of claim 36, externally configured to resemble a motorcycle; and comprising the figure of a rider astride the vehicle, two extremities of the figure being attached respectively to the two side supports and adapted to accommodate the movement away from the frame of the side support which is on the inside of a turn.

38. The vehicle of claim 37, wherein the said two extremities are also adapted to accommodate the respective lowering and raising of the side supports.

39. The toy motorcycle of claim 35, wherein each support is rotatable with respect to the banking means, whereby in a turn friction is reduced between at least one support and such supporting surface.

40. The toy motorcycle of claim 36, wherein, with the motorcycle generally upright on a substantially planar surface:

both wheels contact the said surface;

at least one of the supports is in contact with such surface when the steering mechanism is set for straight-line travel; and during a turn said banking means raises one support and lowers the other support by such distances that, throughout the range of operation of the banking mechanism:

both wheels remain in contact with such surface, and at least one of the supports normally remains in contact with such surface.

41. The toy motorcycle of claim 40 wherein the support which remains in contact with such surface during a turn is:

the support on the inside of the turn, if the speed of the toy generates insufficient centrifugal force to support the toy against the force of gravity; or the support on the outside of the turn, if the speed of the toy generates more centrifugal force than required to counteract gravity; or neither support or both supports, when centrifugal force just balances gravity, depending upon factors such as design detail, tolerances, and wear of mechanical parts in use.

42. The toy motorcycle of claim 40, wherein a support which is not in contact with such surface is at most slightly out of contact with such surface.

43. A toy vehicle comprising:

a frame, a first wheel mounted vertically to the frame for rolling rotation;

a steering fork mounted to the frame for rotation about a nonhorizontal axis;

a second wheel mounted vertically to the steering fork for rotation therewith about said nonhorizontal axis and for rolling rotation;

means, responsive to human manipulation, for controlling the angular position of the steering fork about said nonhorizontal axis;

a pair of outriggers terminating in supports for holding up the toy vehicle, one outrigger and one corresponding support on each side of the vehicle, each outrigger being mounted to the frame for rotation about a respective first outrigger axis which is at a nonzero angle to the vertical, and also about a respective second outrigger axis which is generally horizontal, both outrigger axes being near the end of the outrigger remote from the corresponding support; and means, actuated by the angular-position-controlling means, for orienting the outriggers to bank and support the vehicle when the steering fork is in position for a turn, said outrigger-orienting means comprising:

first means for rotating outward about its first outrigger axis the outrigger on the side toward which the steering fork is turned; and second means for rotating downward about its second outrigger axis the other outrigger.

44. The vehicle of claim 43, wherein the second wheel is in front of the first wheel.

45. The vehicle of claim 43, wherein each support is rotatable with respect to its corresponding outrigger.

46. The vehicle of claim 43, wherein each first outrigger axis is parallel to the plane of said first wheel, whereby rotating either outrigger outward both extends and raises the corresponding support.

47. The vehicle of claim 46, also comprising the figure of a rider astride the vehicle, two extremities of the figure being attached respectively to the two side supports and adapted to accommodate by following:

the rotation outward, and the accompanying ascent, of the outrigger on the side toward which the steering fork is turned; and the rotation downward of the other outrigger.

48. The vehicle of claim 43, wherein the first outrigger-rotating means comprise:

a first cam surface mounted for rotation proportional to the rotation of the steering fork about said nonhorizontal axis; and a first cam follower, mounted for rotation with the respective outrigger about its first outrigger axis, and disposed to engage the first cam surface when the fork is turned toward the side of the vehicle where the last-mentioned outrigger is located.

49. The vehicle of claim 43, wherein the second outrigger-rotating means comprise:

a second cam surface mounted for rotation proportional to the rotation of the steering fork about said nonhorizontal axis; and a second cam follower, mounted for rotation with the respective outrigger about its second outrigger axis, and disposed to engage the second cam surface when the fork is turned away from the side of the vehicle where the last-mentioned outrigger is located.

50. The vehicle of claim 48, wherein the second outrigger-rotating means comprise:

a second cam surface mounted for rotation proportional to the rotation of the steering fork about said nonhorizontal axis; and a second cam follower, mounted for rotation with the respective outrigger about its second outrigger axis, and disposed to engage the second cam surface when the fork is turned away from the side of the vehicle where the last-mentioned outrigger is located.

51. The vehicle of claim 50, wherein the first and second cam surfaces for both outriggers are defined on a single unitary cam body coupled to the steering fork.

52. The vehicle of claim 51, wherein the second cam surfaces for both outriggers are defined on a single protruding element of the unitary cam body.

53. The vehicle of claim 52, wherein the second cam surfaces merge at the tip of the protruding element.

54. The vehicle of claim 51, wherein the first cam surfaces for the two outriggers are formed in opposite ends of the unitary cam body.

55. The vehicle of claim 50, also comprising means for preventing outward rotation of each outrigger unless the steering fork is turned toward the side of the vehicle where that outrigger operates.

56. The vehicle of claim 55, wherein the rotation-preventing means comprise retaining surfaces mounted for rotation proportional to that of the steering fork about said nonhorizontal axis and adapted to engage the first cam follower for each outrigger except when the steering fork is turned toward the side of the vehicle where that outrigger operates.

57. The vehicle of claim 56, wherein the retaining surfaces and the first and second cam surfaces for both outriggers are defined on a single unitary cam body coupled to the steering fork.

58. The vehicle of claim 43, wherein the steering-fork-position-controlling means comprise:

an electric motor mounted to the frame;

a gear train driven by the motor and coupled to drive the steering fork and actuate the banking mechanism.

59. The vehicle of claim 58, wherein the steering-fork-position-controlling means also comprise:

battery mounting and electrical-connection means;

a potentiometer having a wiper driven by the gear train;

a radio receiver mounted to the frame, connected to receiver power from the battery electrical-connection means, and connected with the potentiometer in a bridge circuit to establish electrical current flow and direction thereof between the battery electrical-connection means and the motor when the bridge circuit is unbalanced; and a separately housed radio transmitter having a control member, responsive to human manipulation, for selecting the position of said potentiometer wiper at which the bridge circuit is balanced.

60. The vehicle of claim 59, also comprising a second radio-controlled electric motor mounted to the frame and coupled to drive the said first wheel.

61. The vehicle of claim 60, in combination with at least one electric battery mounted in the battery mounting means and in functional electrical contact with the electrical-connection means.

62. A toy vehicle comprising:

a frame;

a first wheel mounted vertically to the frame for rolling rotation;

a steering fork mounted to the frame for rotation about a nonhorizontal axis;

a second wheel mounted vertically to the steering fork for rotation therewith about said nonhorizontal axis and for rolling rotation;

means, rsponsive to human manipulation, for controlling the angular position of the steering fork about said nonhorizontal axis;

a pair of outriggers terminating in supports for holding up the toy vehicle, one outrigger and one corresponding support on each side of the vehicle, each outrigger being moveable from a first position adjacent to the frame to a second position spaced outwardly from the frame;

means on the frame, actuated by the angular-position-controlling means, for moving said outriggers inwardly and outwardly in coordination with the angular position of the steering fork and for tilting the vehicle toward the inside of each turn.

* * * * *